US007271304B2

(12) United States Patent
Du Toit

(10) Patent No.: US 7,271,304 B2
(45) Date of Patent: Sep. 18, 2007

(54) PROCESS AND APPARATUS FOR THE PRODUCTION OF DIESEL FUELS BY OLIGOMERISATION OF OLEFINIC FEED STREAMS

(75) Inventor: Francois Benjamin Du Toit, Secunda (ZA)

(73) Assignee: Sasol Technology (Pty) Ltd., Johannesburg (ZA)

( * ) Notice: Subject to any disclaimer, the term of this patent is extended or adjusted under 35 U.S.C. 154(b) by 0 days.

(21) Appl. No.: 10/338,082

(22) Filed: Jan. 6, 2003

(65) Prior Publication Data

US 2003/0171632 A1 Sep. 11, 2003

Related U.S. Application Data

(63) Continuation of application No. PCT/ZA01/00091, filed on Jul. 9, 2001.

(51) Int. Cl.
*C07C 2/04* (2006.01)
*C07C 2/08* (2006.01)

(52) U.S. Cl. ..... 585/329; 585/301; 585/324; 585/315; 585/502; 585/510; 585/511

(58) Field of Classification Search ..... 585/301, 585/324, 315, 329, 502, 510, 511
See application file for complete search history.

(56) References Cited

U.S. PATENT DOCUMENTS

| | | | | | |
|---|---|---|---|---|---|
| 4,506,106 | A | * | 3/1985 | Hsia et al. | 585/312 |
| 4,520,215 | A | * | 5/1985 | Owen et al. | 585/255 |
| 4,542,251 | A | * | 9/1985 | Miller | 585/533 |
| 4,864,068 | A | * | 9/1989 | Shamshoum | 585/514 |
| 4,925,996 | A | * | 5/1990 | Mazurek | 585/312 |
| 4,935,568 | A | | 6/1990 | Hartley et al. | 585/300 |
| 5,043,499 | A | | 8/1991 | Harandi et al. | 585/301 |
| 5,080,878 | A | * | 1/1992 | Bowes et al. | 423/713 |
| 5,858,210 | A | * | 1/1999 | Richardson | 208/173 |

OTHER PUBLICATIONS

Annex to Form PCT/ISA/206 in PCT Application PCT/ZA01/00091 Including Results of the Partial International Search.

Venuto, et al. *Organic Catalysis Over Zeolites: a Pespective on Reaction Paths within Micropores*, Microporous Materials, vol. 2, (1994).

Gates, Bruce *Catalytic Chemistry*, John Wily & Sons, Inc. New York, (1992) Chapter 5, *Catalysis in Molecular-Scale Cavities*, pp. 254-309.

Semano, Paul, *Heterogeneous Nickel Catalysts for the Oligomerization of Ethylene*, Dissertation at University of Witwaterrrand, Johannesburg, (2001), pp. 64-81.

Van Bekkum, et al., *Introduction to Zeolite Science and Practice*, Studies in Surface Science and Catalysis, (2001) vol. 137, pp. 11-35.

Nicolaides, et al., *Alkali Metal Cation Exchange of HZSM-5 and the Catalytic Properties of the Alkalized Zeolites*,, Applied Catalysis, 68 (1991) pp. 31-39.

Chu, et al. *Inorganic Cation Exchange Properties of Zeolite ZSM-5*, Intrazeolite Chemistry, (1983) pp. 59-78.

Heveling, et al. *Catalysts and Conditions for the Highly Efficient, Selective and Stable Heterogeneous Oligomerisation of Ethlene*, Applied Catalysis, A: General 173 (1998) pp. 1-9.

Miller, S. J., *Olefin Oligomerization Over High Silica Zeolites*, Catalysis, (1987) pp. 187-197.

O'Conner, C.T., *Oligomerization and Metathesis*, Handbook of Heterogeneous Catalysis, vol. 5, (1997) pp. 2380-2387.

Gates, Bruce *Catalytic Chemistry*, John Wily & Sons, Inc. New York, (1992) Chapter 2, *Catalysis in Solutions*, pp. 15-143.

Bogdanovic, B, *Selectivity Control in Nickel-Catalyzed Olefin Oligomerization*, Advances in Organometallic Chemistry, vol. 17 (1979) pp. 105-141.

* cited by examiner

*Primary Examiner*—Tam M. Nguyen
(74) *Attorney, Agent, or Firm*—Knobbe Martens Olson & Bear LLP

(57) ABSTRACT

This invention provides a process for the production of diesel boiling range hydrocarbons, the process including at least the steps of obtaining an olefinic feed stream from one or more hydrocarbon producing processes wherein the olefinic feed stream contains branched short chain olefins having a chain length of from three to eight carbon atoms, and contacting the feed stream with a shape selective medium pore acid zeolite catalyst in a pressurised reactor at elevated temperature so as to convert said short chain olefins to higher hydrocarbons. The invention also provides an apparatus for carrying out the process and recovering the catalyst for reuse.

22 Claims, 2 Drawing Sheets

PROCESS AND APPARATUS FOR THE PRODUCTION OF DIESEL FUELS BY OLIGOMERISATION OF OLEFINIC FEED STREAMS

RELATED APPLICATION

This application is a continuation, under 35 U.S.C. § 120, of International Patent Application No. PCT/ZA01/00091, filed on Jul. 9, 2001 under the Patent Cooperation Treaty (PCT), which was published by the International Bureau in English on Jan. 17, 2002, which designates the U.S. and claims the benefit of U.S. Provisional Patent Application No. 60/217,192, filed Jul. 10, 2000 and U.S. Provisional Patent Application No. 60/217,128, filed Jul. 10, 2000.

FIELD OF THE INVENTION

This invention relates to a process and apparatus for the production of diesel fuels and kerosene from an olefin containing stream. More particularly, this invention relates to using oligomerization of olefins for the production of diesel and kerosene fuels. Other products produced are gasoline (naphtha) and gasses.

BACKGROUND OF THE INVENTION

The products of acid-catalyzed reactions of olefins may include primarily olefins from straight oligomerization or mixtures of olefins, paraffins, cycloalkanes and aromatics. The product spectrum is influenced by both reaction conditions and the nature of the catalyst.

The oligomerization of olefins over zeolite catalysts is influenced by many factors; including thermodynamics, kinetic and diffusional limitations, shape-selectivity and side reactions.

Molecular weight growth occurs by condensation of any two olefins to a single higher olefin. The acid-catalysed oligomerization of the olefins occurs via a carbocationic mechanism as shown in the example below:

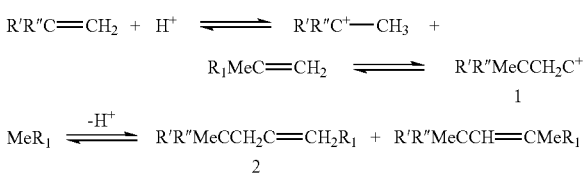

Carbocation 1 can undergo hydride and methyl shifts or it can lead to the formation of trimers via addition of Carbocation 1 to a monomer.

Olefins also undergo double bond and skeletal isomerization. In addition to oligomerization, any two olefins may react to disproportionate to two olefins of two different carbon numbers. Yielding intermediate or "nonoligomer" olefins, this will tend to randomize the molecular weight distribution of the product without significantly changing its average carbon number. Olefin cracking may also occur simultaneously with oligomerization and disproportionation. In practice, the kinetics of the oligomerization, disproportionation and cracking reactions determines the olefin product distribution under process conditions. Olefins may also undergo cyclization and hydrogen transfer reactions leading to the formation of cycloolefins, alkyl aromatics and paraffins, in what has been termed conjunct polymerization.

Thermodynamics dictate that at high temperature or low pressure, the distribution is centred in the light olefin range whereas at low temperature and high pressure, it tends to favour higher molecular weight olefins. At low temperature, mostly pure oligomers are formed with the majority of the product being trimer and tetramer. With increasing temperature, more disproportionation and cracking and, hence, randomization of the olefin distribution occur. At moderate temperatures, the product is essentially random and average carbon number is maximised.

The reactivity of olefins decreases with increasing carbon number due to the diffusional limitations within the pore system and the lower probability of coincident reaction centers of the molecules for a bimolecular reaction.

The ignition performance of diesel fuel represents an important criterion, similar to the octane quality of gasoline. The ignition performance of a diesel fuel, described by the cetane number, is determined by its composition and behaves opposite to octane quality. Hydrocarbons with high octane number have a low cetane number and vice versa.

The cetane, like octane number, is determined by comparative measurements. Mixtures of a-methylnaphthalene with very low ignition quality (cetane number of 0) and cetane (n-hexadecane) with very high ignition quality (cetane number of 100) are used as references. The cetane number of a reference mixture is given by the volume percentage of cetane in a-methylnaphthalene.

A high cetane number is advantageous for the ignition and starting behaviour, the reduction of white and black smoke and noise emission.

None of the classes of substances present in diesel fuel fulfils all the criteria equally well; for example, n-paraffins, which have a very good ignition performance and low smoking tendency, show poor low-temperature behaviour. See Table A below:

TABLE A

Properties of hydrocarbon groups with regard to their suitability for diesel.

| | Cetane no. | Cold Flow Properties | Density | Smoking Tendency |
|---|---|---|---|---|
| n-Paraffins | Good | Poor | Low | Low |
| Isoparaffins | Low | Good | Low | Low |
| Olefins | Low | Good | Low | Moderate |
| Naphthenes | Moderate | Good | Moderate | Moderate |
| Aromatics | Poor | Moderate | High | High |

Density

The density of a diesel fuel has also a considerable effect on the engine performance. Because the quantity of fuel injected into an engine is metered by volume, the mass of fuel introduced into the engine increases with density. A higher fuel density leads to an enrichment of the fuel—air mixture which in principle, yields a higher engine power output; at the same time, however, negative effects on exhaust gas emissions occur.

Sulphur Content

Exhaust gas emissions are also affected by the sulphur content of diesel fuel. In addition, acidic combustion products arising from sulphur can lead to engine corrosion.

Viscosity

For optimal performance, the viscosity of a diesel fuel must lie between narrow limits. Too low a viscosity can lead to wear in the injection pump; too high a viscosity deteriorates injection and mixture formation.

Cold Flow Properties

The composition of diesel fuel also affects its filterability at low temperatures to a great degree. Particularly, n-paraffins with high ignition quality, tend to form wax crystals at low temperatures, which can lead to clogging of the fuel filter. The cloud point and cold filter plugging point (CFPP) give an indication of the low-temperature behaviour of diesel fuels.

Linear olefin containing streams produced by a Fischer-Tropsch (FT) hydrocarbon synthesis process are currently being used as feed streams for processes in which these olefins are oligomerized to form higher hydrocarbons. The catalyst used for the oligomerization is a shape selective ZSM-5 type zeolite having a medium pore size. The oligomerization products typically contain $C_1$–$C_{24}$ (gasses+naphtha+diesel) hydrocarbons having internal olefins which are hydrogenated to form paraffins.

The FT feedstock currently used are streams comprising substantially linear, unbranched short chain olefins such as propylene butene, pentene and Hexene derived from a Fischer-Tropsch process. The Iso paraffins produced are heavily branched, contain aromatics and quaternary carbon atoms all of which inhibit biodegradability of the paraffin and results in a low cetane number. Ideally, the paraffin produced should be low in aromatics, naphtha and sulphur, be biodegradable, have a high cetane number (preferably above 40) and a low cloud point without the need for hydroprocessing the paraffin or adding additives to improve the cloud point and/or cetane number after production.

It has been found by the applicant that the above desirable characteristics may be obtained from a feed stream including olefins derived from hydrocarbon producing processes. The diesel fuel produced is useful in environmentally friendly diesel. Kerosene fraction derived along with the diesel fraction can either be used as illuminating paraffin or as a jet fuel blending component in conventional crude or synthetic derived jet fuels or as reactant (especially $C_{10}$–$C_{13}$ fraction) in the process to produce LAB (Linear Alkyl Benzene).

The naphtha fraction after hydroprocessing can be routed to a thermal cracker for the production of ethylene and propylene or routed to as is to a catalytic cracker to produce ethylene, propylene and gasoline.

The applicant is also aware that presently oligomerization processes, such as those described above, are carried out on a batchwise basis. Some attempts have been made to make the process semi-continuous by providing a plurality of oligomerization reactors in parallel and in series, typically in a 3 by 3 matrix, thereby permitting the oligomerization reaction to proceed in at least one reactor while the catalyst from other reactors is being regenerated in situ in some of the other reactors which are brought on line once their catalyst has been regenerated.

The reason for the level of complexity appears to be the characteristics of the oligomerization reaction and oligomerization catalyst which leads to fouling and deactivation of the catalyst at a high rate requiring frequent or continuous catalyst regeneration. The fouling/deactivation appears to be in the form of coke or blockage of catalyst pores (active sites) by larger molecules.

SUMMARY OF THE INVENTION

Thus, according to the invention, there is provided a process for the production of diesel boiling range hydrocarbons, the process including at least the steps of:

a) obtaining an olefinic feed stream from one or more hydrocarbon producing processes wherein the olefinic feed stream contains branched short chain olefins having a chain length of from three to eight carbon atoms; and b) contacting the feed stream with a shape selective medium pore acid. zeolite catalyst in a pressurised reactor at elevated temperature so as to convert said short chain olefins to higher hydrocarbons.

The diesel boiling range hydrocarbons (after hydrogenation) may be used as an environmentally friendly diesel or as a quality enhancer for existing diesel pools or drilling fluid.

A kerosene fraction may also be recovered and can after hydroprocessing be used either as illuminating paraffin or jetfuel or as a blending component in either crude or synthetic derived jet fuels or as reactant (especially $C_{10}$–$C_{13}$ fraction) in process to produce LAB (linear Athyl Benzene).

In this specification, unless otherwise specified, the term "diesel boiling range" is to be understood to include paraffins boiling between 180° C. and 360° C.

The olefinic feed stream may be pretreated by removing oxygenates therefrom.

The removal of oxygenates from the olefinic stream may take place by various methods known in the art, for example, extraction.

The hydrocarbon producing processes from which the olefinic stream is derived may include one or more processes selected from the group including:

- a Fischer-Tropsch process;
- a Fluid Catalytic Cracking (FCC) process/DCC Deep Catalytic Cracking process;
- a tar sands olefin recovery process;
- a shale oil olefin recovery process;
- a Thermal Cracking process; and/or
- a Carbonisation process, for example, coker offgas and/or coker naphtha.

By Fischer-Tropsch process is meant a Fischer-Tropsch process carried out at above 180° up to 380° C.

By Thermal Cracking is meant the cracking of light paraffins ($C_2$, $C_3$'s), naphtha and gasoils to produce ethylene and other short chain hydrocarbons. This is a term used in the art.

The olefinic stream derived from the FT process may includes mainly linear and branched olefins generally having a chain length of from three to eight carbon atoms.

The olefins may be linear, methyl, di-methyl, and/or ethyl branched, for example, 1-pentene, 1-hexene, 2-methyl-3-hexene, 1,4-dimethyl-2 hexene.

The olefinic stream derived from the FCC or DCC (Deep Catalytic Cracking process may include mostly branched olefins having a chain length of from three to eight carbon atoms, the chains being primarily methyl and/or di-methyl branched.

The olefinic stream derived from the Thermal Cracking process may include branched and linear olefins having a chain length of from three to five carbon atoms which is separated from the ethylene contained in the effluent of the cracking process by means of distillation, cryogenic separation methods or membrane separation techniques prior to use.

The olefinic streams derived from carbonisation processes may stem from offgas including coker and/or naphtha coker reactor effluent streams. Said offgas is highly olefinic and is separated from the rest of the effluent stream by means of distillation processes prior to use. The olefins contained in said offgas may be linear or branched and may have a chain length of from three to four carbon atoms. Olefinic coker naphtha having from five to eight carbon atoms may also be used as a suitable feedstock.

The olefins of the olefinic streams as described above having chain lengths of two or more carbon atoms may contain more than one double bond.

The olefins derived from the tar sands olefin recovery process are obtained by a thermal pyrolysis process such as coking, fluid coking, and the like.

The olefins derived from the shale oil olefin recovery process are obtained by a thermal pyrolysis process, for example, coking.

Any combination of the abovementioned olefinic streams may be used as the olefinic feed stream to the process such that said stream contains at least 10% branched olefins having a chain length of from two to eight carbon atoms. The branching of the olefins in said stream is predominantly methyl branching.

Said stream may contain approximately 80% branched olefins.

The catalyst with which the olefinic feed stream is contacted may be a catalyst of the shape selective or pentasil ZSM-5 zeolite types. Its shape selectivity will ensure that the higher hydrocarbon produced after oligomerization does not contain excessively branched hydrocarbons The reactor used for the oligomerization process may be at a pressure of between 5000 kPa and 8000 kPa, preferably 6500 kPa and at a temperature of between 200° C. and 340° C., preferably 200–250° C.

The higher hydrocarbon product or diesel boiling range hydrocarbons may be predominantly methyl-branched with a small amount ethyl-branching and substantially no propyl-branching. Typically, the branching of the diesel boiling range hydrocarbons is in excess of 10 % branched. Typically the branching is methyl-branching.

The diesel boiling range hydrocarbons may have a chain length of between twelve and twenty-four carbon atoms with a cetane number exceeding 40 and typically being over 50.

It may contain less than 5% aromatics and less than 40% naphtha by volume.

The diesel boiling range hydrocarbons cloud point after hydroprocessing may be between <−30° C. and <−55° C. and may preferably be <−50° C.

The diesel boiling range hydrocarbons may be useful as a diesel fuel for CI (compression ignition) engines.

The diesel range boiling hydrocarbons may be useful as additives to an existing diesel fuel or as a drilling fluid. The kerosene boiling range hydrocarbon may be used as IP (illuminating paraffin) or as a jet fuel blending component in crude or synthetic derived jet fuels.

The diesel boiling range hydrocarbons may be useful as diesel fuel improvers for improving the characteristics of existing diesel fuels.

The diesel boiling range hydrocarbon may be blended with another diesel fuel in a ratio of between 1:100 and 90:10. Typically the ratio is between 10:90 and 80:20, but could be 30:70, 50:50, 70:30, or any other ratio providing a desired diesel fuel.

According to a second aspect of the invention, there is provided a process for the production of diesel and kerosene boiling range hydrocarbons, the process including at least the steps of:

a) obtaining a predominantly linear olefinic feed stream from one or more hydrocarbon producing processes selected from
   a Low Temperature Fischer-Tropsch (LTFT) process;
   a High Temperature Fischer-Tropsch (HTFT) process;
   a Fluid Catalytic Cracking (FCC) process;
   an Ethylene Cracking process;
   a Carbonisation process;
   a tar sands olefin recovery process; and
   a shale oil olefins recovery process;

wherein said olefinic feed stream contains short chain olefins having a chain length of from three to eight carbon atoms; and b) contacting the feed stream with a shape selective medium pore acid zeolite catalyst in a pressurised reactor at elevated temperature so as to convert said short chain olefins to higher hydrocarbons; and c) provided that, where the linear olefinic feedstream includes olefins produced by the LTFT process, said olefinic feedstream includes olefins produced by at least one other hydrocarbon producing process.

By Low Temperature Fischer-Tropsch process (LTFT) is meant a Fischer-Tropsch process carried out at between 200° C. and 300° C., usually 240° C. or 280° C.

By High Temperature Fischer-Tropsch process (HTFT) is meant a Fischer-Tropsch process carried out at above 300° C., usually 340° C.

By Ethylene Cracking is meant the cracking of naphtha to produce ethylene and other short chain hydrocarbons. This is a term used in the art.

The diesel boiling range hydrocarbons may be used as an environmentally friendly diesel or as a quality enhancer for existing diesel pools.

For the second aspect of the invention the term "diesel boiling range" may be understood to include paraffins boiling between 180° C. and 360° C.

The olefinic feed stream may be pretreated by removing oxygenates, sulphur dienes, etc therefrom.

The olefinic feedstream may be pretreated by removing some of any branched olefins present in the feedstream therefrom prior to oligomerization.

The removal of oxygenates sulphur and dienes from the olefinic stream may take place by various methods known in the art, for example, extraction or catalytic The olefinic feedstream derived from the Carbonisation process may be derived from Coker offgas and/or Coker naphtha.

Prior to oligomerization, and in order to produce a desired diesel boiling range hydrocarbon, the olefinic feedstream may be blended with another olefinic feedstream derived from the HTFT process which may include mainly linear and branched olefins generally having a chain length of between three and eight carbon atoms, predominantly between six and eight carbon atoms, typically methyl, di-methyl, and/or ethyl branched, for example, 2-methyl-3-heptene, and 1,4-dimethyl-2 hexene.

Prior to oligomerization, and in order to produce a desired diesel boiling range hydrocarbon, the olefinic feedstream may be blended with another olefinic feedstream derived from the FCC process which includes mostly branched olefins having a chain length of between three and eight carbon atoms, the chains being primarily methyl and/or di-methyl branched.

The olefinic stream derived from the Ethylene Cracking process may include predominantly linear and branched olefins having a chain length of between three and four carbon atoms which is separated from the ethylene contained in the effluent of the cracking process by means of distillation, cryogenic distillation or membrane separation techniques prior to use.

The olefinic streams derived from carbonisation processes may stem from offgas including Coker and/or naphtha Coker reactor effluent streams. Said offgas is highly olefinic and is separated from the rest of the effluent stream by means of distillation prior to use. The olefins contained in said offgas may include linear and branched olefins which have a chain length of between three and eight carbon atoms. ($C_3$–$C_8$)

The olefins of the olefinic streams as described above having chain lengths of four or more carbon atoms may contain more than one double bond.

Any combination of the abovementioned olefinic streams may be used as the olefinic feed stream to the process such that said stream contains predominantly linear olefins having a chain length of from three to eight carbon atoms. The branching of any branched olefins in said stream is predominantly methyl branching.

The olefinic feedstream which is oligomerized may include a fraction obtained from a synthetic process, such as Fischer-Tropsch, and a fraction obtained from a crude oil process, such as FCC, thereby to maximise the production of diesel boiling range hydrocarbons.

The catalyst with which the olefinic feed stream is contacted may be a catalyst of the shape selective ZSM-5 zeolite type. Its shape selectivity will ensure that the higher hydrocarbon produced after oligomerization does not contain excessively branched hydrocarbons, for example, pentasil zeolite such as $SiO_2/Al_2O_3$ ratio 30–1000.H— or Na form.

The diesel range boiling hydrocarbons may be useful as additives to an existing diesel fuel or as a drilling fluid component or white oil feedstock. The kerosene boiling range hydrocarbon may be used as IP (illuminating paraffin) or as a jet fuel blending component in crude or synthetic derived jet fuels or as reactant (especially $C_{10}$–$C_{13}$ fraction) to produce LAB (linear Alkyl Benzene).

According to a further aspect of the invention, there is provided an apparatus for carrying out a continuous oligomerization process, for example, for the production of diesel and kerosene boiling range hydrocarbons as described above, the apparatus including a) a reactor for contacting an olefinic feed stream which contains short chain olefins having a chain length of from 2 to 8 carbon atoms with a shape selective zeolite catalyst under elevated temperature and pressure so as to convert the short chain olefins to higher hydrocarbons in the diesel boiling range; and b) a catalyst regenerator including means for removing deactivated or spent catalyst from the reactor while it is in operation; and means for reintroducing regenerated catalyst into the reactor while it is in operation and the oligomerization reaction is proceeding.

The reactor may be operated at relatively high pressures of about 20 to 100 bar, typically 60 bar, and at a temperature of between 150° C. and 300° C., typically 200° C. to 250° C., with a zeolitic oligomerization catalyst, such as Pentasil catalyst.

The reactor may be a tubular reactor, a fixed bed reactor, or any other reactor type suitable for carrying out the oligomerization reaction.

In contrast to the reactor, the catalyst regenerator for the regeneration of the catalyst may operate at relatively low pressures of 1 to 5 bar, typically 1 to 2 bar and at temperatures of about 500° C. to 1000° C., typically 500° C. to 550° C., to burn off the coke or hydrocarbons fouling the catalyst.

The catalyst regenerator means for removing the spent catalyst from the reactor includes a pressure reduction system for taking the catalyst from the relatively high operating pressure of the reactor down to the relatively low operating pressure of the catalyst regenerator.

The pressure reduction system may include a lock hopper and a disengagement hopper, the lock hopper having an inlet in flow communication with the reactor and an outlet in flow communication with the disengagement hopper which is in flow communication with the catalyst regenerator, thereby isolating the high pressure of the reactor from the low pressure of the catalyst regenerator.

The means for reintroducing the regenerated catalyst into the reactor may include pressurising means isolated from the catalyst regenerator thereby permitting the pressure of a regenerated catalyst stream to be increased to reactor operating pressure without increasing the pressure in the catalyst regenerator.

The pressurising means may include a regenerated catalyst flow control system which is configured for safe operation thereof, a lock hopper, and pressure increasing means, for example, a venturi compressor, a mechanical compressor, or the like, which introduces a pressurised fluid into the regenerated catalyst stream.

The pressurised fluid may be a reactant used in the reactor for oligomerising the olefinic feedstream.

The catalyst regeneration means includes heating means for heating the spent catalyst to regeneration temperature.

The apparatus as set out above is useful when the olefinic feedstream for the process is obtained from one or more hydrocarbon producing processes selected from a Low Temperature Fischer-Tropsch (LTFT) process;
a High Temperature Fischer-Tropsch (HTFT) process;
any suitable Fischer-Tropsch process;
a Fluid Catalytic Cracking (FCC) process;
an Ethylene Cracking process; (e.g. Thermal steam cracker)
a Carbonisation process; (e.g. Coker)
a crude oil refining process;
a tar sands olefin recovery process; and
a shale oil olefins recovery process.

By Low Temperature Fischer-Tropsch process (LTFT) is meant a Fischer-Tropsch process carried out at between 200° C. and 300° C., usually 240° C. or 280° C.

By High Temperature Fischer-Tropsch process (HTFT) is meant a Fischer-Tropsch process carried out at above 300° C., usually 340° C.

Other suitable FT processes may be carried out at temperatures of between 180° C. to 380° C.

DETAILED DESCRIPTION OF THE PREFERRED EMBODIMENT

The invention is now described, by way of illustration only, with reference to the accompanying diagrammatic representation.

Figure 4:
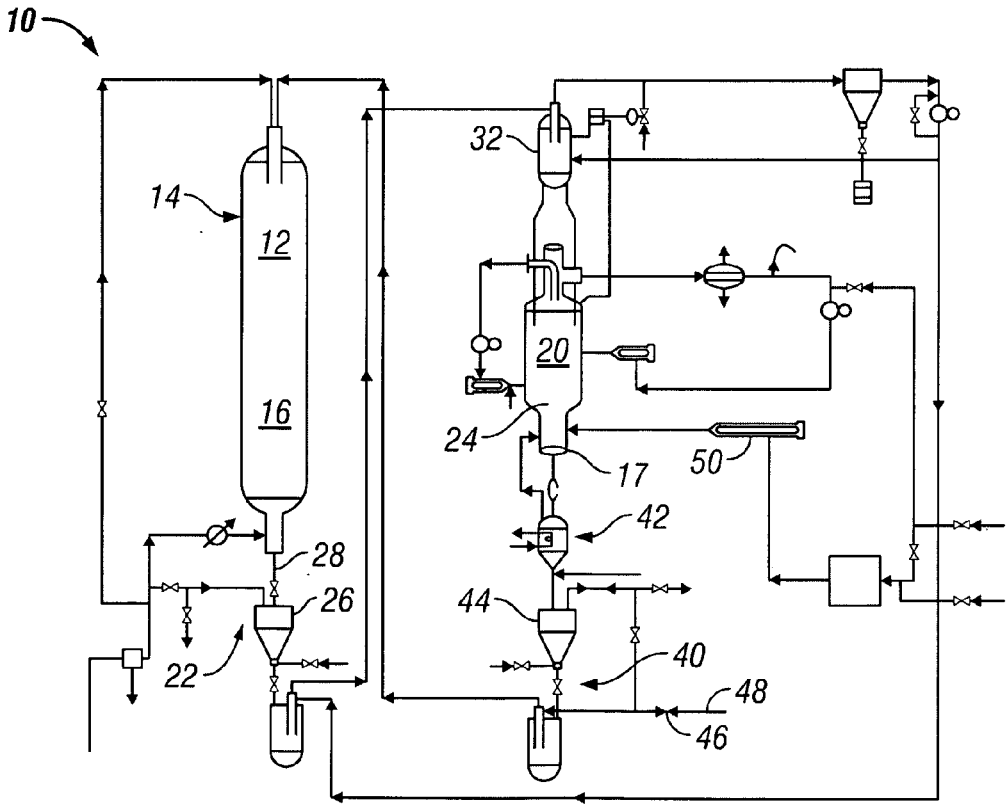
FIG. 4 depicts an apparatus for carrying out a continuous oligomerization of olefins.

In FIG. 4, reference numeral 10 generally indicates an apparatus for carrying out a continuous oligomerization of olefins.

The apparatus 10 comprises a fixed bed reactor 12 operated at 200° C. to 250° C. at 60 bar was fed with a synthetic olefinic feedstream 14 including $C_3$ to $C_8$ olefins which feedstream was contacted with a Pentasil catalyst 16 in the reactor 12 to oligomerise the feedstream to diesel and kerosene boiling range hydrocarbons.

The catalyst 16 becomes fouled with coke/hydrocarbons and is substantially deactivated after a short residence period in the reactor 12 and must be regenerated.

The apparatus 10 thus includes a catalyst regenerator 20 including means for removing the spent catalyst from the reactor, which includes a pressure reduction system 22 for taking the catalyst 16 from the relatively high operating pressure of the reactor 12 down to the relatively low operating pressure of the catalyst regenerator vessel 24.

The pressure reduction system 22 includes a lock hopper 26 and a disengagement hopper 32. The lock hopper 26 has an inlet 28 in flow communication with the reactor 12 and an outlet 30 in flow communication with the disengagement hopper 32 which is in flow communication with the catalyst regenerator vessel 24, thereby isolating the high pressure of the reactor 12 from the low pressure of the catalyst regenerator vessel 24.

Various valves and pipework are provided between the reactor 12 and the hoppers 26 and 32, however, this aspect does not form part of the invention and conventional systems may be used.

The catalyst regenerator 20 includes means for reintroducing the regenerated catalyst 17 into the reactor 12. This means includes pressurising means 40 isolated from the catalyst regenerator vessel 24 thereby permitting the pressure of a regenerated catalyst stream 17 to be increased to reactor operating pressure without increasing the pressure in the catalyst regenerator vessel 24.

The pressurising means 40 includes a regenerated catalyst flow control system 42, a lock hopper 44, and pressure increasing means, in the form of a venturi compressor 46 which introduces a pressurised fluid 48 into the regenerated catalyst stream 17.

The pressurised fluid 48 is typically a reactant used in the reactor 12 for oligomerising the olefinic feedstream, for example, hydrogen gas.

The catalyst regenerator 20 includes heating means 50 for heating the spent catalyst 17 to regeneration temperature.

EXAMPLE 1

A feed of a mixture of '$C_6/C_7$ Hydro feed' (ca 54%) and 'Combined offcuts' (46%) from SSF had the following composition:

TABLE 1

GC analyses of the feed before mixing

| | COMBINED OFFCUTS MASS % | C6 HYDRO FEED MASS % |
|---|---|---|
| C2 | 0.0000 | 0.0034 |
| C3 | 0.0853 | 0.0033 |
| C4 paraffins | 0.0078 | 0.0000 |
| C4 normal olefins | 0.0149 | 0.0044 |
| C4 branched olefins | 0.0000 | 0.0000 |
| C4 cyclic olefins | 0.0000 | 0.0000 |
| C5 paraffins | 2.3847 | 0.0581 |
| C5 normal olefins | 5.7065 | 0.1496 |
| C5 branched olefins | 0.7259 | 0.0236 |
| C5 cyclic olefins | 0.9403 | 0.0200 |
| C6 paraffins | 8.1610 | 0.4356 |
| C6 normal olefins | 29.3436 | 4.1058 |
| C6 branched olefins | 43.9337 | 2.7436 |
| C6 cyclic olefins | 2.6755 | 2.3365 |
| C7 paraffins | 1.1321 | 8.3618 |
| C7 normal olefins | 0.3142 | 33.1883 |
| C7 branched olefins | 0.0000 | 21.4356 |

TABLE 1-continued

GC analyses of the feed before mixing

| | COMBINED OFFCUTS MASS % | C6 HYDRO FEED MASS % |
|---|---|---|
| C7 cyclic olefins | 0.0000 | 4.6974 |
| C8 paraffins | 0.3746 | 0.6139 |
| C8 normal olefins | 3.6979 | 5.1601 |
| C8 branched olefins | 0.0000 | 0.0000 |
| C8 cyclic olefins | 0.0000 | 0.0000 |
| Total Dienes | 0.1420 | 0.5151 |
| Total Aromatics | 0.0000 | 4.5374 |
| Carbonyls | 0.3227 | 1.6185 |
| Unknown C8 | 0.5615 | 8.0998 |
| Unknown C9 | 0.0000 | 2.3287 |
| Unknown C10 | 0.0000 | 0.3160 |
| Unknown C11 | 0.0000 | 0.3003 |
| Unknown C12 | 0.0000 | 0.2588 |

The feed is highly branched; it has predominantly methyl- and dimethyl-branching with traces of ethyl-branching. The feed had about 2.0 wt. of oxygenates which are mainly carbonyls and small amounts of alcohols. See Table 7 for the full analyses of oxygenates in the feed and the products.

Reactors and Conditions Used

The first of step of the reaction, which is oligomerization, was carried out at Sudchemie using PDU 146 Test Rig. The conditions used were as follows:

TABLE 2

Conditions Used - Oligomerization Step

| | | |
|---|---|---|
| Catalyst volume | 1200 | $cm^3$ = 744 g |
| Fresh feed | 0.5 | kg/kg catalyst/h |
| Recycle Ratio | 2.5 | |
| Hydrogen feed | 8 | Nl/h |
| Pressure | 58 | bar |
| Start of run temperature | 240° | C. |
| End of run temperature | 250° | C. |

Daily adjustment of temperature by 1.5° C. was used to compensate for the loss in catalyst activity.

Product yields obtained were as follows:

TABLE 3

Product yields

| | Wt. |
|---|---|
| $H_2O$ | 1.0 |
| Gas (LPG) | 4.36 |
| Gasoline | 33.78 |
| Distillate | 60.87 |

The distillate and gasoline fractions were then sent for hydrogenation in FTRC using a sulphided KF 841 Ni/Mo catalyst. The conditions for the hydrogenation were as follows:

TABLE 4

Conditions for hydrogenation

| | | |
|---|---|---|
| Pressure | 50 | bar |
| Temperature | 270° | C. |
| LHSV | 1.5 | $h^{-1}$ |
| $H_2$/Feed ratio | 600 | (volume) |
| Amnt DMDS added to feed | 0.8 | g/litre of feed |

Analyses

The analyses done on the diesel after hydrogenation are as follows:

Bromine number, cetane number, density, sim-dist, viscosity@40° C., aromatics (mono-, di- and tri-), flash point, gc, pour point, cloud point, CFPP, as well as lubricity (also done on the unhydrogenated diesel).

The petrol fraction will also be analysed for bromine number, D86, RVP, GC and RON.

Figure 1:
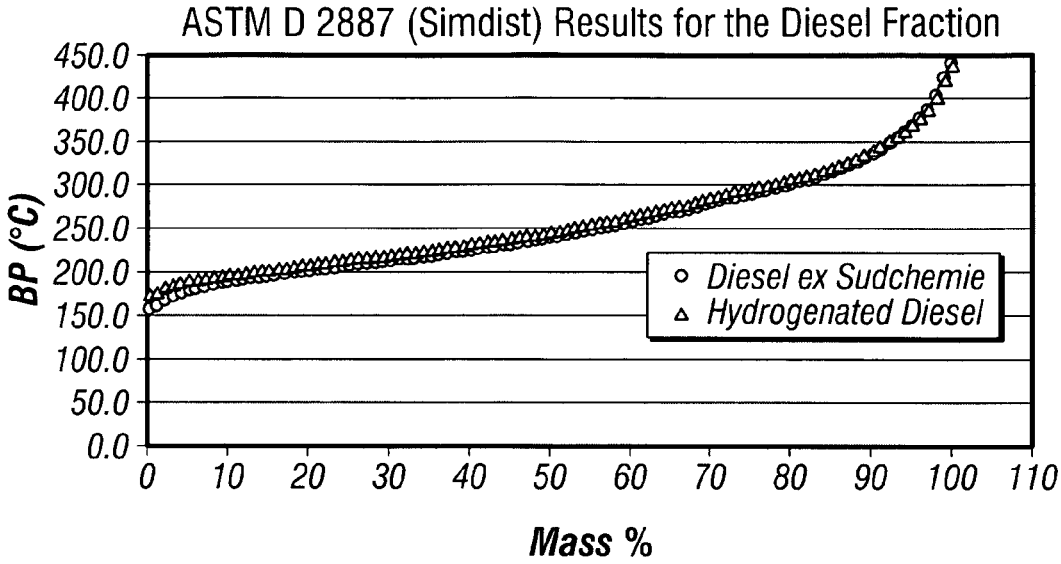
FIG. 1 provides simdist results of the unhydrogenated and hydrogenated diesel fraction.

The diesel fraction was sent for ASTM D2887 to determine the boiling point distribution and the results are shown in FIG. 1.

Figure 2:
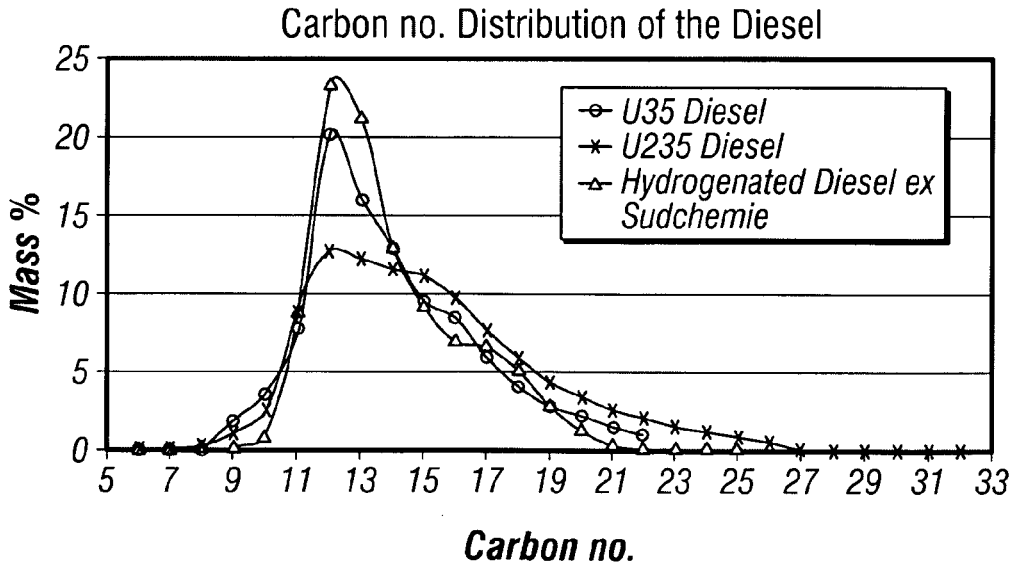
FIG. 2 provides carbon number distribution of the diesel fractions.

The carbon number distribution of the diesel fraction was determined and compared to the carbon number distribution of our conventional diesel from U35 and U235. The boiling point distribution and the carbon number distribution of the COD diesel compares very closely with the diesel from U35 and U235. See FIG. 2.

To determine the degree of isomerization of the diesel, the iso/normal ratio was calculated by dividing the amount of iso-hydrocarbons with the amount of normal paraffins. This calculation was carried out for each carbon no. and the results are shown in FIG. 3.

Figure 3:
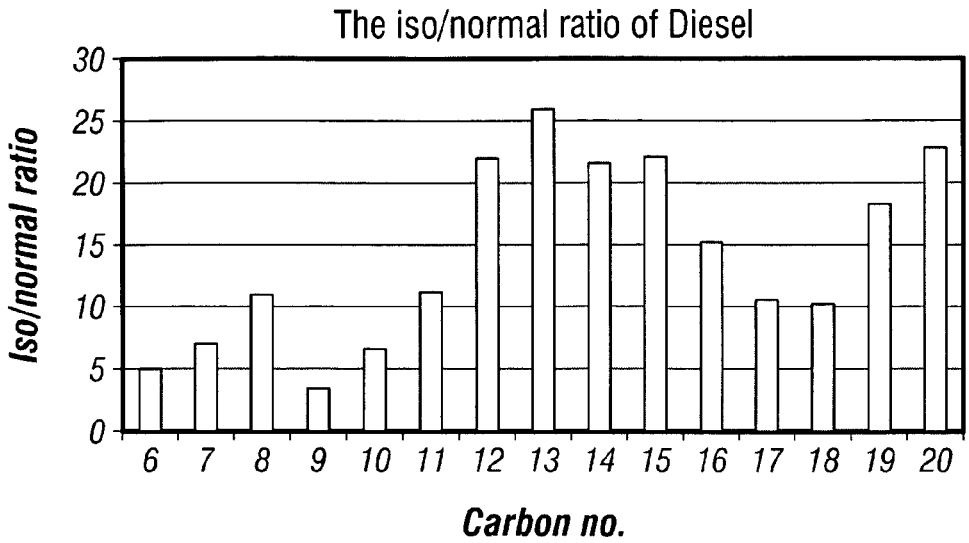
FIG. 3 provides the ratio of iso to normal paraffins in the diesel.

In FIG. 3 the isoparaffins include oxygenates and aromatics that are present The diesel fraction was also analysed using NMR. The sample was dissolved in deuterated chloroform and $^{13}C$ and DEPT spectra were recorded using 5 mm 4 nucleus probe. From the analyses, the following branching parameters were quoted:

TABLE 5

The type of branching in the diesel product

| Type of branching | Wt. |
|---|---|
| Branching with 2 methyl groups | 13.2 |
| Branching with 3 methyl groups | 25.7 |
| Branching with 4 methyl groups | 24.3 |
| Branching with 5+ methyl groups | 15.4 |
| Branching with ethyl groups | 11.0 |
| Branching with propyl groups | 10.4 |

As shown in FIG. 3 and Table 8 above, the level of branching observed in this product is very high and it can be explained as follows:

The feed used is highly branched with methyl, dimethyl and even ethyl branching. See the GC analysis of the feed in the appendix The acid-catalysed oligomerization of the olefins occurs via a carbocationic mechanism as shown in the example below:

Carbocation can undergo hydride and methyl shifts or it can lead to the formation of trimers via addition of carbocation to a monomer. Thus the dimers and trimers formed in this process can lead to highly branched hydrocarbons depending on the type of molecules being reacted. This explains high degree of branching in the diesel fraction. The other contributing factor to the degree of branching is probably the isomerization of the reactants due to the acid function of the catalyst.

The unhydrogenated diesel fraction was analyzed for aromatic hydrocarbons. The analysis was performed on HP 1090 liquid chromatograph instrument connected to a UV detector and the results were as follows:

TABLE 6

Aromatic content of the unhydrogenated diesel fraction (mass %)

| MAH | BAH | PAH | Total aromatics |
|---|---|---|---|
| 7.31 | 0.647 | 0.1452 | 8.1022 |

MAH => monocyclic aromatics, BAH => bicyclic aromatics, PAH => polycyclic aromatic Total amount of aromatics in hydrogenated diesel fraction was 6.06 mass %.

Aromatic content of the feed is about 2%. Hence the aromatics found in the diesel fraction were formed during the reaction and are mainly mono-aromatics with alkyl branching.

No oxygenates were found in the product. This means that both the alcohols and carbonyls take part in the reaction. The alcohols are dehydrated to olefins while oxygenates probably condensed further to form heavier compounds. Oxygenates have a considerable effect on catalyst cycle time, as their presence causes premature catalyst deactivation. See Table 7 below for analysis of oxygenates:

TABLE 7

GC-AED analyses of samples from the COD process (mass %)

| Components | Feed | Petrol | Unhyd Diesel | Final Diesel |
|---|---|---|---|---|
| Methanol | 0.041 | <0.001 | <0.001 | <0.001 |
| Acetaldehyde | 0.017 | <0.001 | <0.001 | <0.001 |
| 2-propanone | 0.013 | 0.012 | <0.001 | 0.002 |
| 2-butanone | 0.191 | <0.001 | <0.001 | <0.001 |
| 3-methyl-2-butanone | 0.031 | <0.001 | <0.001 | <0.001 |
| 1-butanol | 0.222 | 0.022 | <0.001 | <0.001 |
| 2-pentanone | 0.278 | <0.001 | <0.001 | <0.001 |
| 3-pentanone | 0.225 | <0.001 | <0.001 | <0.001 |
| 1-pentanol | 0.103 | <0.001 | <0.001 | <0.001 |
| 2-hexanone | 0.437 | <0.001 | <0.001 | <0.001 |
| Unknown lighter than 1-butanol | 0.130 | 0.047 | <0.001 | <0.001 |
| Unknown lighter than 1-pentanol | 0.255 | 0.093 | <0.001 | <0.001 |
| Unknown lighter than 1-hexanol | 0.219 | 0.004 | <0.001 | <0.001 |
| Unknown lighter than 1-octanol | 0.007 | <0.001 | <0.001 | <0.001 |
| Total Oxygenates | 2.169 | 0.178 | <0.001 | 0.002 |

More results are shown in Table 8 below.

TABLE 8

Results for the Hydrogenated Diesel Fraction

| Property | Units | Specifications 2000 | 2005 | 2010 | Results | |
|---|---|---|---|---|---|---|
| Bromine number | gBr/100 g | 13 | | | 0.30 | |
| Sulphur | Mass % | 0.3 | 0.3 — 0.05 | 0.05 | 2.0 | ppm |

TABLE 8-continued

Results for the Hydrogenated Diesel Fraction

| Property | Units | Specifications 2000 | 2005 | 2010 | Results | |
|---|---|---|---|---|---|---|
| Viscosity @ 40° C. | cSt | 2.2 to 4.5 | 2.2 to 4.5 | 2.0 to 4.0 | 2.46 | |
| Cetane number | | 45 | 48 | 50 | 45.2 | |
| Density | g/cc | 0.85 | 0.80 to 0.84 | 0.79 to 0.82 | 0.7934 | |
| Total Aromatics | Mass % | — | 30 | 15 | 6.06 | |
| Polycyclic Aromatics | Mass % | — | 5 | 3 | 0.0 | |
| CFPP | ° C. | −8 | −10 | −10 | <−38 | |
| Cloud point | ° C. | | −10 maximum | | <−38 | - 60(SCI - Lab) |
| Pour point | ° C. | | −10 max | | | - 60(SCI - Lab) |
| E90 | ° C., max | 362 | 350 | — | 339 | |
| E95 | ° C., max | — | 365 | 350 | 369 | |
| Flash point | ° C. | | | | 79 | |
| Lubricity (Hyd-diesel) | Um | <400 | | | 537 | |
| Lubricity (Unhyd-diesel) | Um | | | | 464 | |

EXAMPLE 2

An olefinic feed stream from an HTFT process comprising

| | | |
|---|---|---|
| Olefins | $C_3$ | 36.7 wt % |
| | $C_4$ | 30.8 wt % |
| | $C_5$ | 11.6 wt % |
| Paraffins | $C_3$ | 3.8 wt % |
| | $C_4$ | 17.0 wt % |
| | $C_5$ | 0.1 wt % |

The above feedstream was oligomerized at ±260° C. and ±60 bar(g) pressure in the presence of a shape selective pentasil zeolite for 2 hours.

Under the above conditions and with the olefinic feed stream as described above a diesel boiling range hydrocarbon useful as a diesel fuel, and having the following characteristics may be produced.

| Olefins: | Kg/kg Olefins converted | Paraffins: | Kg/kg Olefin converted |
|---|---|---|---|
| $C_6$ | 0.0079 | $C_1$ | 0 |
| $C_7$ | 0.0258 | $C_2$ | 0 |
| $C_8$ | 0.0216 | $C_3$ | 0.0056 |
| $C_9$ | 0.0183 | $C_4$ | 0.0138 |
| $C_{10}$ | 0.0253 | $C_5$ | 0.0144 |
| $C_{11}$ | 0.0406 | $C_6$ | 0.0118 |
| $C_{12}$ | 0.0984 | $C_7$ | 0.0266 |
| $C_{13}$ | 0.1235 | $C_8$ | 0.0152 |
| $C_{14}$ | 0.1448 | $C_9$ | 0.0154 |
| $C_{15}$ | 0.0847 | $C_{10}$ | 0.0058 |
| $C_{16}$ | 0.0973 | $C_{11}$ | 0.0001 |
| $C_{17}$ | 0.05 | $C_{12}^+$ | 0 |
| $C_{19}$ | 0.066 | | 0.1089 |
| $C_{20}$ | 0.0225 | | |
| $C_{21}^+$ | 0.0194 | | |
| | 0.8911 | | |

EXAMPLE 3

An olefininc feedstream from an HTFT process comprising

| | | |
|---|---|---|
| Olefins | $C_5$ | 0.8 wt % |
| | $C_6$ | 43.90 wt % |
| | $C_7$ | 28.97 wt % |
| | $C_8$ | 1.8 wt % |
| Paraffins | $C_5$ | 0.6 wt % |
| | $C_6$ | 1.6 wt % |
| | $C_7$ | 7.8 wt % |
| | $C_8$ | 5.0 wt % |
| Aromatics | | 1.8 wt % |
| Oxygenates | | 4.4 wt % |
| Dienes | | 0.1 wt % |
| Other | | balance |

The above was oligomerized at ±260° C. and ±60 bar(g) pressure in the presence of a shape selective pentasil zeolite for 2 hours.

Under the above conditions and with the olefinic feed stream as described above a diesel boiling range hydrocarbon useful as a diesel fuel, and having the following characteristics may be produced.

Diesel range ($C_{10}$–$C_{24}$): 68 wt % of feed

Gasoline range ($C_5$–$C_9$): 30 wt of feed

The diesel fuel having the above composition has a Cetane number of about 50 and a CFPP of about −20 to −24° C.

EXAMPLE 4

An olefininc feedstream having the following components was oligomerized as per examples 1 and 2 above.

| Conversion per pass | |
|---|---|
| $C_3$ = | 99 wt % |
| $C_4$ = | 85.4 wt % |

-continued

| Conversion per pass | |
|---|---|
| $C_5$ = | 83.6 wt % |
| $C_6$ = | 84.2 wt % |
| $C_7$ = | 52.5 wt % |
| $C_8$ = | 18.2 wt % |

Typical Yields (Based on ±80 wt % Olefins in feed)

| Yields on Olefins | |
|---|---|
| Fuelgas | 0.03 kg/kg |
| Gasoline | 0.18 kg/kg |
| Diesel | 0.79 kg/kg |

The claims that follow form an integral part of the specification as if specifically reproduced here.

What is claimed is:

1. A process for the production of diesel fuel, the process comprising the steps of:

a) obtaining an olefinic feed stream from one or more hydrocarbon producing processes wherein the olefinic feed stream comprises short chain olefins having a chain length of from three to eight carbon atoms, wherein a portion of the short chain olefins are branched; and b) contacting the feed stream with a catalyst consisting essentially of a shape selective medium pore acid zeolite in a pressurised reactor at an elevated temperature so as to convert said short chain olefins to higher hydrocarbons, whereby a diesel fuel is obtained that comprises predominantly iso-hydrocarbons.

2. A process as claimed in claim 1, wherein the olefinic feed stream is pretreated by removing oxygenates therefrom.

3. A process as claimed in claim 1, wherein the hydrocarbon producing processes from which the olefinic stream is derived comprise one or more processes selected from the group consisting of:

a Fischer-Tropsch (FT) process;

a Fluid Catalytic Cracking (FCC) process/DCC Deep Catalytic Cracking process;

a tar sands olefin recovery process;

a shale oil olefin recovery process;

a Thermal Cracking process; and a Carbonisation process.

4. A process as claimed in claim 1, wherein the olefinic stream derived from the FT process comprises mainly linear and branched olefins generally having a chain length of from three to eight carbon atoms.

5. A process as claimed in claim 1, wherein olefins of the olefinic feedstream are selected from the group consisting of linear olefins, methyl olefins, di-methyl olefins, ethyl branched olefins, and mixtures thereof.

6. A process as claimed in claim 5, wherein the olefins comprise one or more olefins selected from the group consisting of 1-pentene, 1-hexene, 2-methyl-3-hexene, and 1,4-dimethyl-2hexene.

7. A process as claimed in claim 3, wherein the olefinic stream derived from the FCC or DCC comprises mostly branched olefins having a chain length of from three to eight carbon atoms, the chains being primarily methyl and/or di-methyl branched.

8. A process as claimed in claim 3, wherein the olefinic stream derived from the Thermal Cracking process comprises branched and linear olefins having a chain length of from three to five carbon atoms which are separated from ethylene contained in the effluent of the cracking process by distillation, cryogenic separation methods, or membrane separation techniques prior to use.

9. A process as claimed in claim 3, wherein the olefinic streams derived from the carbonisation processes stem from offgas comprising coker and/or naphtha coker reactor effluent streams and said offgas are highly olefinic and are separated from the rest of the effluent stream by distillation processes prior to use, and wherein olefins contained in said offgas are linear or branched and have a chain length of from three to four carbon atoms.

10. A process as claimed in claim 3, wherein the olefinic feed stock comprises olefinic coker naphtha having from five to eight carbon atoms.

11. A process as claimed in claim 3, wherein any combination of the hydrocarbon producing processes derived olefinic feed stream is used as the olefinic feed stream to the process such that said stream contains at least 10% branched olefins having a chain length of from three to eight carbon atoms and wherein the branching of the olefins in said stream is predominantly methyl branching.

12. A process as claimed in claim 11, wherein the olefinic feed stream comprises approximately 80% branched olefins.

13. A process as claimed in claim 1, wherein the catalyst with which the olefinic feed stream is contacted comprises a pentasil ZSM-5 zeolite catalyst or a shape selective catalyst.

14. A process as claimed in claim 1, wherein the reactor used for the process is at a pressure of between 5000 kPa and 8000 kPa, and at a temperature of between 200° C. and 340° C.

15. A process as claimed in claim 14, wherein the reactor is at a pressure of 6500 kPa and a temperature of from 200° C. to 240° C.

16. A process for the production of diesel fuel, the process comprising the steps of:

a) obtaining a predominantly linear olefinic feed stream from one or more hydrocarbon producing processes selected from the group consisting of:

a Low Temperature Fischer-Tropsch (LTFT) process;

a High Temperature Fischer-Tropsch (HTFT) process;

a Fluid Catalytic Cracking (FCC) process;

an Ethylene Cracking process;

a Carbonisation process;

a tar sands olefin recovery process; and a shale oil olefins recovery process;

wherein said olefinic feed stream comprises short chain olefins having a chain length of from three to eight carbon atoms;

b) contacting the feed stream with a catalyst consisting essentially of a shape selective medium pore acid zeolite in a pressurised reactor at elevated temperature so as to convert said short chain olefins to higher hydrocarbons, whereby a diesel fuel is obtained that comprises predominantly iso-hydrocarbons; and c) provided that, where the linear olefinic feedstream comprises olefins produced by the LTFT process, said olefinic feedstream comprises olefins produced by at least one other hydrocarbon producing process.

17. A process as claimed in claim 16, wherein the olefinic feed stream is pretreated by removing oxygenates and sulphur-dienes therefrom.

18. A process as claimed in claim 16, wherein the olefinic feed stream is pretreated by removing some of any branched olefins present in the feedstream therefrom prior to the production of said hydrocarbons.

19. A process as claimed in claim 16, wherein prior to step b) the olefinic feedstream is blended with another olefinic feedstream derived from the HTFT process which comprises mainly linear and branched olefins generally having a chain length of between three and eight carbon atoms.

20. A process as claimed in claim 19, wherein the olefins derived from the HTFT process have predominantly between six and eight carbon atoms and are methyl, di-methyl, and/or ethyl branched.

21. A process as claimed in claim 16, wherein prior to step b) the olefinic feedstream is blended with another olefinic feedstream derived from the FCC process which comprises mostly branched olefins having a chain length of between three and eight carbon atoms, the olefins being primarily methyl and/or di-methyl branched.

22. A process as claimed in claim 16, wherein the catalyst with which the olefinic feed stream is contacted is a shape selective ZSM-5 zeolite catalyst.

* * * * *